US006948210B1

(12) United States Patent
Shah

(10) Patent No.: US 6,948,210 B1
(45) Date of Patent: Sep. 27, 2005

(54) AUTOMATED BOARD ERASER

(76) Inventor: Chirag Shah, 2213 Deer Crest Ct., San Jose, CA (US) 95138

( * ) Notice: Subject to any disclaimer, the term of this patent is extended or adjusted under 35 U.S.C. 154(b) by 258 days.

(21) Appl. No.: 10/259,059

(22) Filed: Sep. 26, 2002

(51) Int. Cl.[7] ..... B43L 1/00; A47L 11/38
(52) U.S. Cl. ..... 15/98; 15/246; 434/417
(58) Field of Search ..... 15/97.1, 98, 103, 15/246; 434/411, 417

(56) References Cited

U.S. PATENT DOCUMENTS

| | | | | |
|---|---|---|---|---|
| 1,561,320 | A * | 11/1925 | Glidric et al. | 15/250.29 |
| 1,798,215 | A * | 3/1931 | Neilson | 15/103 |
| 2,167,296 | A * | 7/1939 | Farmer | 15/98 |
| 3,163,943 | A * | 1/1965 | Bell | 434/417 |
| 3,218,663 | A * | 11/1965 | Battista | 15/250.11 |
| 3,454,976 | A * | 7/1969 | Kijinski | 15/250.01 |
| 3,731,335 | A * | 5/1973 | Chrisp | 15/97.1 |
| 3,858,265 | A * | 1/1975 | Schlick | 15/77 |
| 4,257,138 | A * | 3/1981 | Clements et al. | 15/4 |
| 5,216,776 | A * | 6/1993 | Dennison | 15/312.1 |
| 5,319,820 | A * | 6/1994 | Forst | 15/98 |
| 5,649,828 | A * | 7/1997 | Kawashima | 434/411 |
| 5,957,700 | A * | 9/1999 | Ariyama | 434/417 |
| 6,073,297 | A * | 6/2000 | Lee | 15/102 |
| 6,353,193 | B1 | 3/2002 | Atwood et al. | |
| 6,370,720 | B1 * | 4/2002 | Jang | 15/98 |
| 6,394,610 | B2 | 5/2002 | Rodriguez, Jr. | |
| 6,421,042 | B1 | 7/2002 | Omura et al. | |

FOREIGN PATENT DOCUMENTS

| | | |
|---|---|---|
| TW | 467835 | 12/2001 |
| WO | WO 98/14888 | 9/1997 |

OTHER PUBLICATIONS tool-tribe, Tool-Tribe Connector®, product information sheet, pp. 1-4.
PC Connection, Inc., Electronic Eraser, Virtual Ink Corp., Mfr. Part No. 850-0004, Product Detail, 2002.
"mimio for Windows," Virtual Ink Corp. product information sheet.
PolyVision Corporation, "Webster TS Series" Webster Touch Sensitive (TS) Series Interactive whiteboards, product information detail, 2001.
"Copy Cam Systems," OptiMA, Inc., product information detail, 2002.
eBeam, The Wesbster Laser Tracking (ST) Series and The Webster Interactive Plasma Display (IPD), product information, Electronics for Imaging, Inc.
"SMART Board Interactive Whiteboard," Smart Technologies, Inc., product information detail, 2002.
Numonics Corporation, Interactive WhiteBoard, product information detail.
Numonics Corporation, Interactive Presentation Manager, product information detail.
Numonics Corporation, Digital Presentation Appliance, product information detail.
Numonics Corporation, Presentation Pro, product information detail.

(Continued)

*Primary Examiner*—Randall Chin
(74) *Attorney, Agent, or Firm*—Beyer Weaver & Thomas, LLP

(57) ABSTRACT

An automated erasure system that is suitable for erasure of non-permanent markings from boards is disclosed. The boards being erased can be whiteboards (whether electronic or not) or other boards (e.g., chalkboards).

9 Claims, 5 Drawing Sheets

OTHER PUBLICATIONS

Numonics Corporation, Podium Pro, product information detail.
"eBeam: Electronics for Imaging," product information sheet.
PLUS BF-060 Electronic White Board, Officetronics, product information detail.
Column Office Equipment, Inc., "Electronic Whiteboards," product information detail, 2000.

* cited by examiner

AUTOMATED BOARD ERASER

BACKGROUND OF THE INVENTION

1. Field of the Invention

The present invention relates to hand-written notation boards and, more particularly, to erasure of hand-written notation boards.

2. Description of the Related Art

Whiteboards are a well-known medium that provide a convenient surface upon which notes, drawings, charts or other hand-written notations may be made. Whiteboards are often used in group discussions as whiteboard facilitate sharing of individual thoughts in group discussions. As with traditional chalkboards, whiteboards allow notations to be made in multiple colors. Like chalkboards, the various hand-written notations made on whiteboards are erasable by the manual manipulation of an eraser.

Whiteboards offer several advantages over chalkboards including a clean white surface which provides for greater contrast over the traditional green background of chalkboards. In addition, writing on a whiteboard is easier than writing on a traditional chalkboard. For example, the smooth writing surface of the whiteboard allows easy use of erasable felt-tip markers, whereas the chalkboard surface provides a somewhat scratchy surface with which chalk is used. Whiteboard markers also tend to be easier to grip and less messy than chalk.

Unfortunately, however, both whiteboards and chalkboards are erased by manual user action, which is tedious. Typically, a user would obtain an eraser and then apply the eraser to the surface of the whiteboard or chalkboard in an often non-uniform motion to wipe-off the hand-written notations thereon. Such manual erasure is time consuming and deemed a chore. Following manual erasure, the board is often spotty, meaning that some remnants of the prior hand-written notations remain. Another disadvantage of manual erasing is that the marker or chalk remnants can cause a dust to develop about the eraser, and thus the user's hand can be dirtied by the erasure process.

Although electronic whiteboards are available and gaining favor in the marketplace, they are expensive and have difficulty performing an erasure function. There are at least two different types of electronic whiteboards. One type of electronic whiteboard is where the board is made of plastic or plastic-like material, frequently referred to as a screen, that moves back and forth exposing different surfaces to write on. Another type of electronic whiteboard is where the board has a fixed surface or screen to write on. Electronic whiteboards have the capability to display hand-written notations written on the surface of the whiteboard and to also store digital data representing the handwritten notations. The surface of the electronic whiteboard is also often erased in the same manual manner as non-electronic whiteboards.

Therefore, there is a need for improved approaches to erase boards.

SUMMARY OF THE INVENTION

Broadly speaking, the invention relates to techniques for automated erasure of non-permanent markings from boards, such as whiteboards (whether electronic or not) or other boards (e.g., chalkboards).

The invention can be implemented in numerous ways, including as a method, system, apparatus, and computer readable medium. Several embodiments of the invention are discussed below.

As a system for automatic erasure of a board, one embodiment of the invention includes at least: an eraser member for use in erasing non-permanent markings on the board; a support means for supporting the eraser member against the board when erasing at least a portion of the non-permanent markings from the board; and a motor operatively connected to the support means to drive the eraser member across the board while the support means supports the eraser member against the board.

As a system for automatic erasure of a board, another embodiment of the invention includes at least: an eraser member for use in erasing non-permanent markings on the board; a support means for supporting the eraser member against the board when erasing at least a portion of the non-permanent markings from the board; a motor operatively connected to the support means to drive the eraser member across the board while the support means supports the eraser member against the board; a user-activated switch operatively coupled to the motor, the user-activated switch activates the motor when a user desires to erase the non-permanent markings from the board; and at least one sensor operatively connected to the motor, the sensor operating to deactivate the motor.

As a system for automatic erasure of a board, still another embodiment of the invention includes at least: a motor; a pair of rods placed at opposite ends of the board, at least one of the rods capable of being rotatably driven by the motor; first and second pulleys affixed to each of the rods; a first belt provided across the board and around the first pulley of each of the rods; a second belt provided across the board and around the second pulley of each of the rods; an eraser member affixed to the first and second belts; and a user switch to activate the motor. When the motor is activated, the at least one of the rods turns to rotate the first and second pulleys affixed to the at least one of the rods, thereby causing the first and second belts to turn and thereby move the eraser member across the board to erase non-permanent markings from the board.

As a system for automatic erasure of a board, yet still another embodiment of the invention includes at least: a motor; a rod having at least one gear, the rod being positioned proximate to one side of the board, and the rod capable of being rotatably driven by the motor; at least one threaded rod extending at least substantially over the length of the board, the at least one threaded rod having at least one counterpart gear that is coupled against the at least one gear of the rod; an eraser member having at least one threaded opening to receive the at least one threaded rod; and a user switch to activate the motor. When the motor is activated, the rod is rotatably driven to rotate the at least one gear as well as the at least one counterpart gear coupled thereto, thereby causing the at least one threaded rod to rotate and thereby move the eraser member across the board to erase non-permanent markings from the board.

As a method for automatically erasing a board, one embodiment of the invention includes the acts of: receiving a user request to erase non-permanent markings on the board; activating a motor to drive an eraser strip across the board after the user request has been received; determining whether erasure of the board is completed; deactivating the motor to cease driving the eraser strip across the board once the determining determines that the erasure of the board is completed.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The invention provides an automated erasure system that is suitable for erasure of non-permanent markings from boards, such as whiteboards (whether electronic or not) or other boards (e.g., chalkboards).

Embodiments of the invention are discussed below with reference to FIGS. 1A–4. However, those skilled in the art will readily appreciate that the detailed description given herein with respect to these figures is for explanatory purposes as the invention extends beyond these limited embodiments.

Figure 1A:
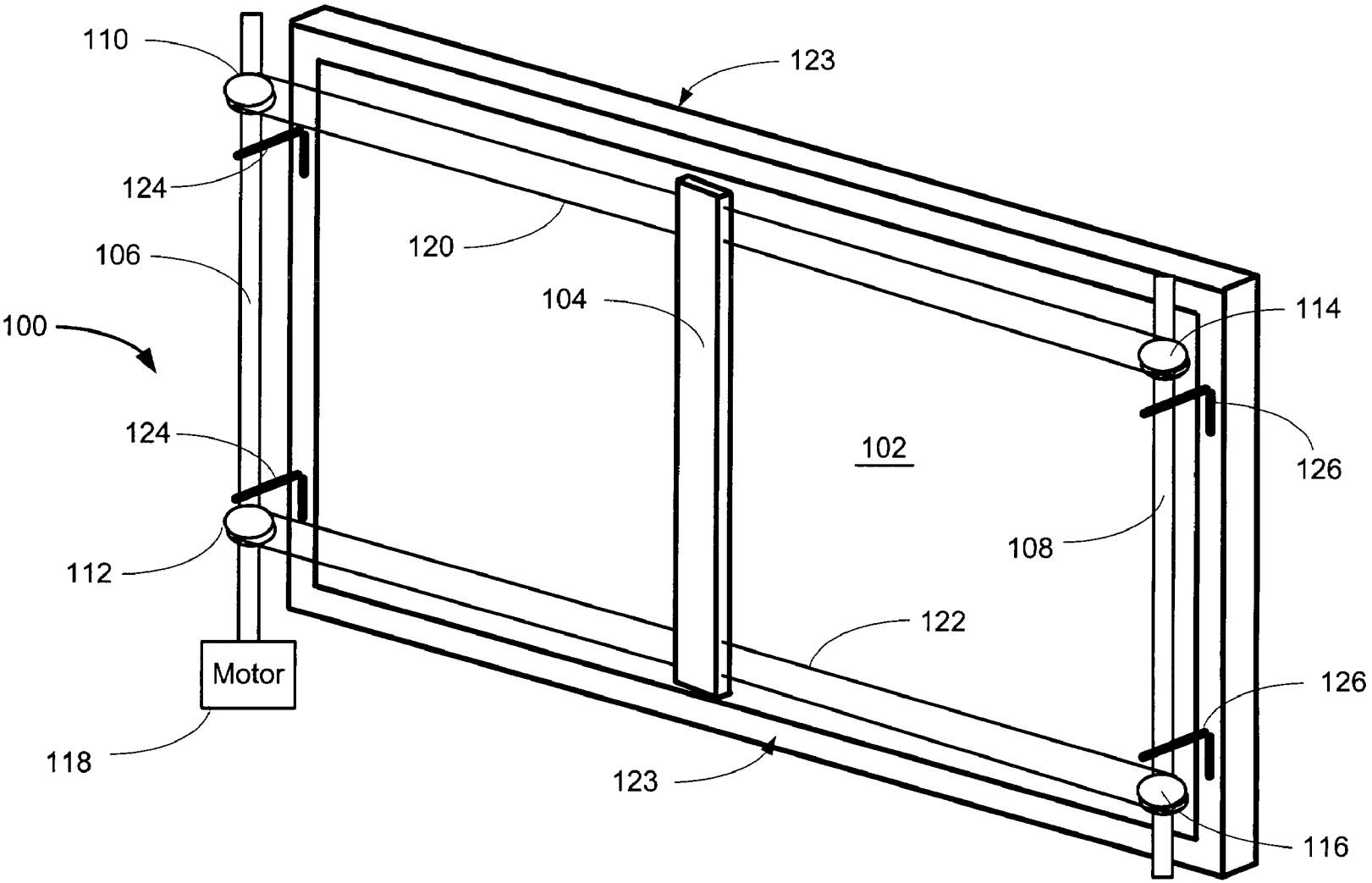
FIG. 1A is a diagram of an automatic board erasure system according to one embodiment of the invention.

FIG. 1A is a diagram of an automatic board erasure system 100 according to one embodiment of the invention. The automatic board erasure system 100 is depicted with reference to a board 102. The automatic board erasure system 100 operates to automatically erase non-permanent markings that have been previously placed on the board 102. For example, the board 102 can be a chalkboard or a whiteboard. The whiteboard can be an electronic board, with a moving screen or a fixed screen.

The automatic board erasure system 100 includes an eraser member 104 that is directed across the surface of the board 102 to erase any non-permanent markings that have been previously placed on the board (i.e., on the surface of the board 102). The eraser member 104 can be a strip or a bar of material that abuts against the surface of the board 102 during the erasure process.

The automatic board erasure system also includes a first rod 106 and a second rod 108. The first rod 106 has pulleys 110 and 112 affixed thereto, and the second rod 108 has pulleys 114 and 116 affixed thereto. When the erasure process is to be performed, a motor 118 drives the rod 106 in a rotational manner. The rotation of the rod 106 causes the pulleys 110 and 112 to rotate. A first belt 120 is provided between the pulleys 110 and 114, and a second belt 122 is provided between the pulleys 112 and 116. The belts 120 and 122 can be made out of a variety of different materials. In one embodiment, the belts 120 and 122 can be a rubber belts, and in other embodiments, the belts 120 and 122 can be chains or ropes. In any case, the eraser member 104 is coupled to the belts 120 and 122. Hence, as the motor 118 drives the rod 106 which in turn drives the pulleys 110 and 112, the belts 120 and 122 are also driven such that the eraser member 104 is moved across the surface of the board 102, thereby erasing any non-permanent markings therefrom.

In one embodiment, as shown in FIG. 1A, the eraser member 104 extends across substantially the entire width of the board 102. As the motor 118 causes the eraser member 104 to be driven across the length of the board 102, the entire surface of the board 102 is able to be erased in a uniform manner. Typically, the motor 118 need only drive the eraser member 104 over the board 102 in a single pass.

Still further, in order to affix the automatic board erasure system 100 such that it is proximate to the board 102 to be erased, brackets 124 can couple the first rod 106 to a frame 123 of the board 102 or to a wall to which the board 102 is attached. Likewise, brackets 126 can be used to couple the second rod 106 to the frame 123 of the board 102 or a wall to which the board 102 is attached.

Figure 1B:
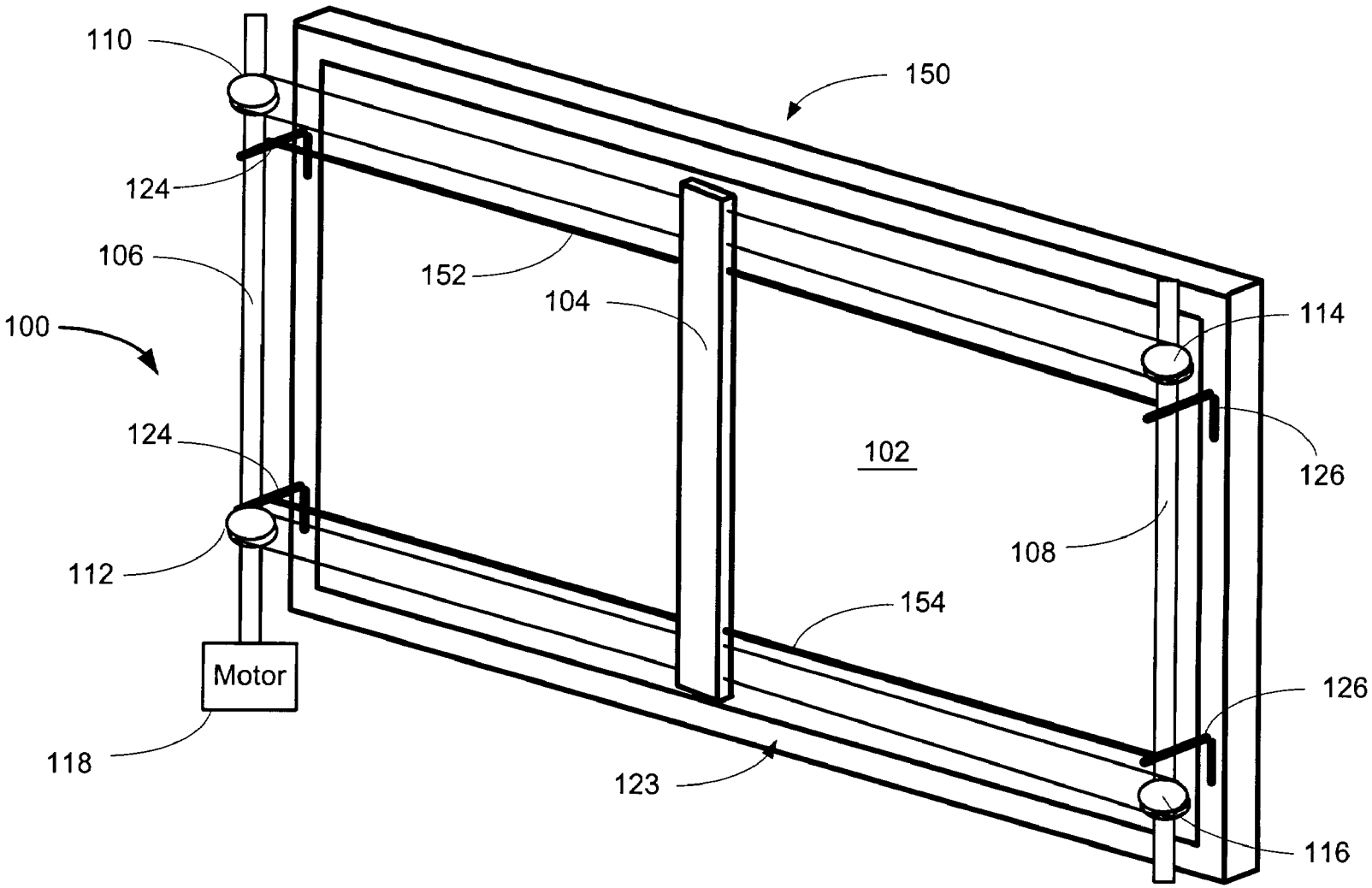
FIG. 1B is a diagram of an automatic board erasure system according to another embodiment of the invention.

FIG. 1B is a diagram of an automatic board erasure system 150 according to another embodiment of the invention. The automatic board erasure system 150 generally includes the features and components of the automatic board erasure system 100 illustrated in FIG. 1A. However, the automatic board erasure system 150 further includes a first guide bar 152 and a second guide bar 154. The guide bars 152 and 154 can be mounted in a variety of different ways to the frame 123 of the board 102 or to the wall to which the board 102 is attached. For example, the guide bars 152 and 154 can be coupled to the brackets 124 and 126 illustrated in FIG. 1A. Alternatively, the guide bars 152 and 154 can be supported by separate brackets. In any case, the guide bars 152 and 154 serve to guide the eraser member 104 in a controlled and uniform manner across the surface of the board when being driven by the motor 118. Additionally, the guide bars 152 and 154 can also serve to bias the eraser member 104 against the surface of the board 102. In other words, the guide bars 152 and 154 can exert a force on the eraser member 104 that causes the eraser member 104 to be pressed against the surface of the board 102. This additional force can serve to improve the erasability provided by the automatic board erasure system 150.

In one embodiment, the eraser member 104 would have an opening passing there through that resembles the cross-sectional shape of the guide bars 152 and 154. For example, if the guide bars 152 and 154 have a circular cross-section, then the eraser member 104 would have holes passing there through which allow the guide bars 152 and 154 to pass through the eraser member 104, thus thereby allowing the eraser member 104 to slide along the guide rods 152 and 154 when being driven by the motor 118.

Although FIG. 1B illustrates the automatic board erasure system 150 as having two sets of pulleys and a pair of belts as well as a pair of guide rods, in other embodiments less components may be used. For example, in one embodiment, one set of pulleys, a single belt and a single guide rod can be used. An example of one such embodiment can use the pulleys 114 and 116, the belt 122, and the guide rod 152.

Figure 2:
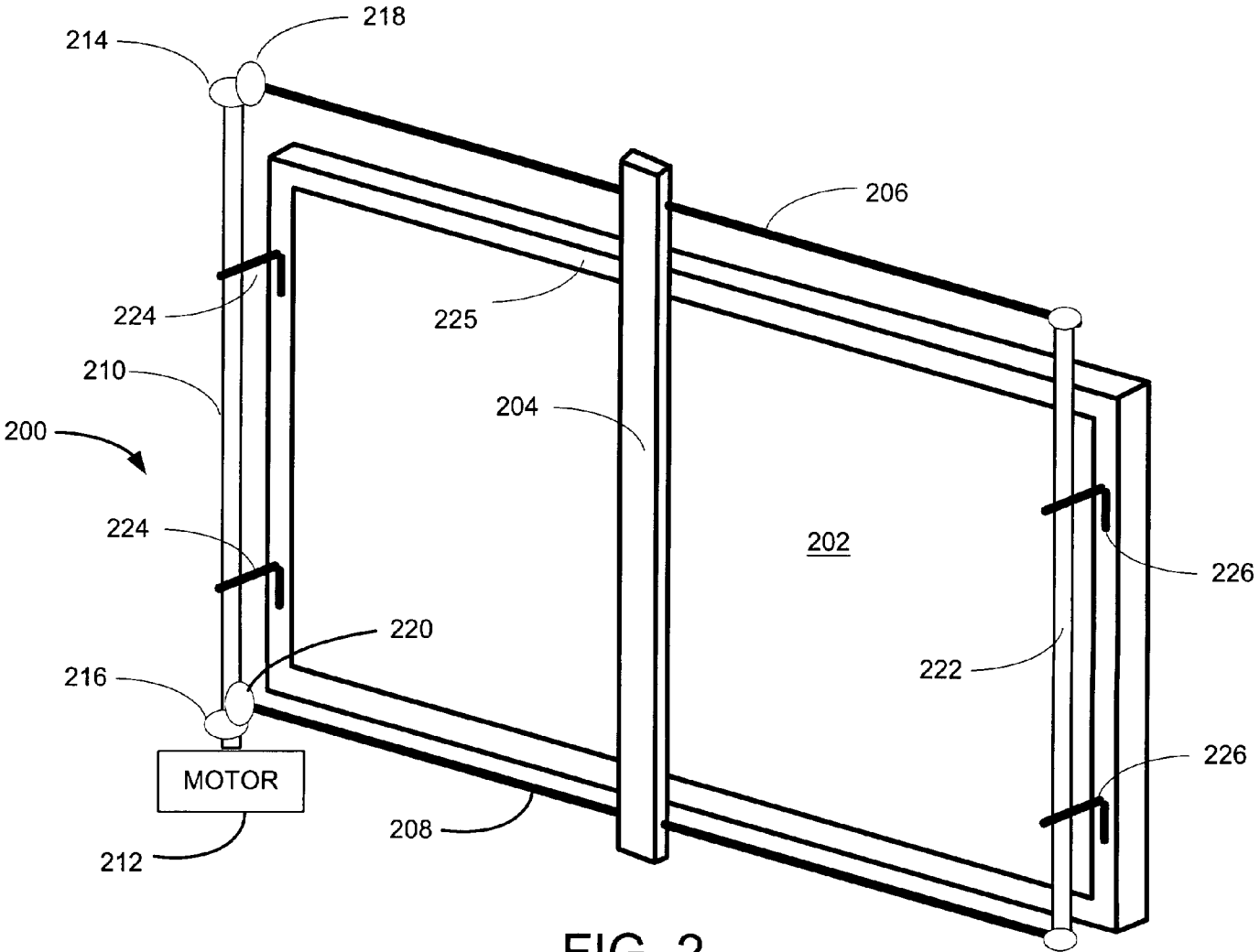
FIG. 2 is a diagram of an automatic board erasure system according to still another embodiment of the invention.

FIG. 2 is a diagram of an automatic board erasure system 200 according to still another embodiment of the invention. The automatic board erasure system 200 operates to erase non-permanent markings from a board 202. For example, the board 102 can be a chalkboard or a whiteboard. The whiteboard can be an electronic board, with a moving screen or a fixed screen.

The automatic board erasure system 200 includes an eraser member 204 that is driven across the surface of the board 202 to erase the non-permanent markings therefrom. The eraser member 204 is held in place and driven across the surface of the board 202 by a first threaded rod 206 and a second threaded rod 208. The first and second threaded rods 206 and 208 are driven by a drive rod 210. The drive rod 210 is driven by a motor 212. In particular, the motor 212 causes the drive rod 210 to rotate when the motor 212 is activated. The drive rod 210 includes a first gear 214 and a second gear 216. The first gear 214 couples to a first counterpart gear 218 that is affixed to one end of the first threaded rod 206. Similarly, the second gear 216 is coupled to a second counterpart gear 220 that is affixed to one end of the threaded rod 208. The opposite ends of the first threaded rod 206 and the second threaded rod 208 are held in place by a support arm 222. The support arm 222 holds the other ends of the first and second threaded rods 206 and 208 in place, yet allows the first and second threaded rods 206 and 208 to rotate. Support brackets 224 are provided to support the drive rod 210 and couple to a frame 225 of the board 202 or to a surface to which the board 202 is attached. Support brackets 226 affix the support arm 222 to either the frame 225 of the board 202 or a surface to which the board 202 is attached.

When the motor 212 is activated, such as under the control of a user switch (not shown), the drive rod 210 rotates, thereby rotating the first and second gears 214 and 216. When the first and second gears 214 and 216 rotate, the first and second counterpart gears 218 and 220 then rotate which in turn causes the first and second threaded rods 206 and 208 to rotate. The first and second threaded rods 206 and 208 have, in one embodiment, outer threads, namely, having threads on their outer surface. The eraser member 204 has an opening at each end through which the first and second threaded rods 206 and 208 respectively pass. The inner surface of the opening at the ends of the eraser member 204 are provided with inner threads that mesh with the counterpart outer threads on the first and second threaded rods 206 and 208. Hence, as the first and second threaded rods 206 and 208 are rotated, the eraser member 204 is driven across the surface of the board 202. Consequently, the eraser member 204, when driven across the surface of the board 202, operates to automatically erase any non-permanent markings from the surface of the board 202.

The threaded rods 206 and 208 can thus serve to guide the eraser member 204 in a controlled and uniform manner across the surface of the board 202 when being driven by the motor 212. Additionally, the threaded rods 206 and 208 can also serve to bias the eraser member 204 against the surface of the board 202. In other words, the threaded rods 206 and 208 can exert a force on the eraser member 204 that causes the eraser member 204 to be pressed against the surface of the board 202. This additional force can serve to improve the erasability provided by the automatic board erasure system 200.

Although FIG. 2 illustrates the automatic board erasure system 200 as having two sets of gears and a pair of threaded rods, in other embodiments, less components may be used. For example, in one embodiment, one set of gears, a single threaded rod and a single guide rod can be used. An example of one such embodiment can use the gears 216 and 220, the threaded rod 206, and a guide rod (more generally, a linear bearing) in place of the threaded rod 206.

According to another embodiment, the force directing the eraser member 104 against the surface of the board 102 can be adjusted with respect to either the automatic board erasure system 100 illustrated in FIG. 1A or the automatic board erasure system 150 illustrated in FIG. 1B. For example, the eraser member 104 can be provided with tension screws to adjustably control the amount of force the belts 120 and 122 and/or the guide bars 152 and 154 induce on the eraser member 104. Similarly, the force directing the eraser member 204 against the surface of the board 202 can also be adjustable with respect to the automatic board erasure system 200 illustrated in FIG. 2. The ability to adjustably control the force induced on the eraser member can be used to increase the force with which the eraser member presses against the board during erasure. The ability to adjustably control the force induced on the eraser member also allows for adjustments due to imperfect mounting of the system or due to imperfections with respect to the surface of the board. In addition, the eraser member, although generally rigid, can provide some flexibility such that it is able to adapt to imperfections in the surface of the board.

Figure 3:
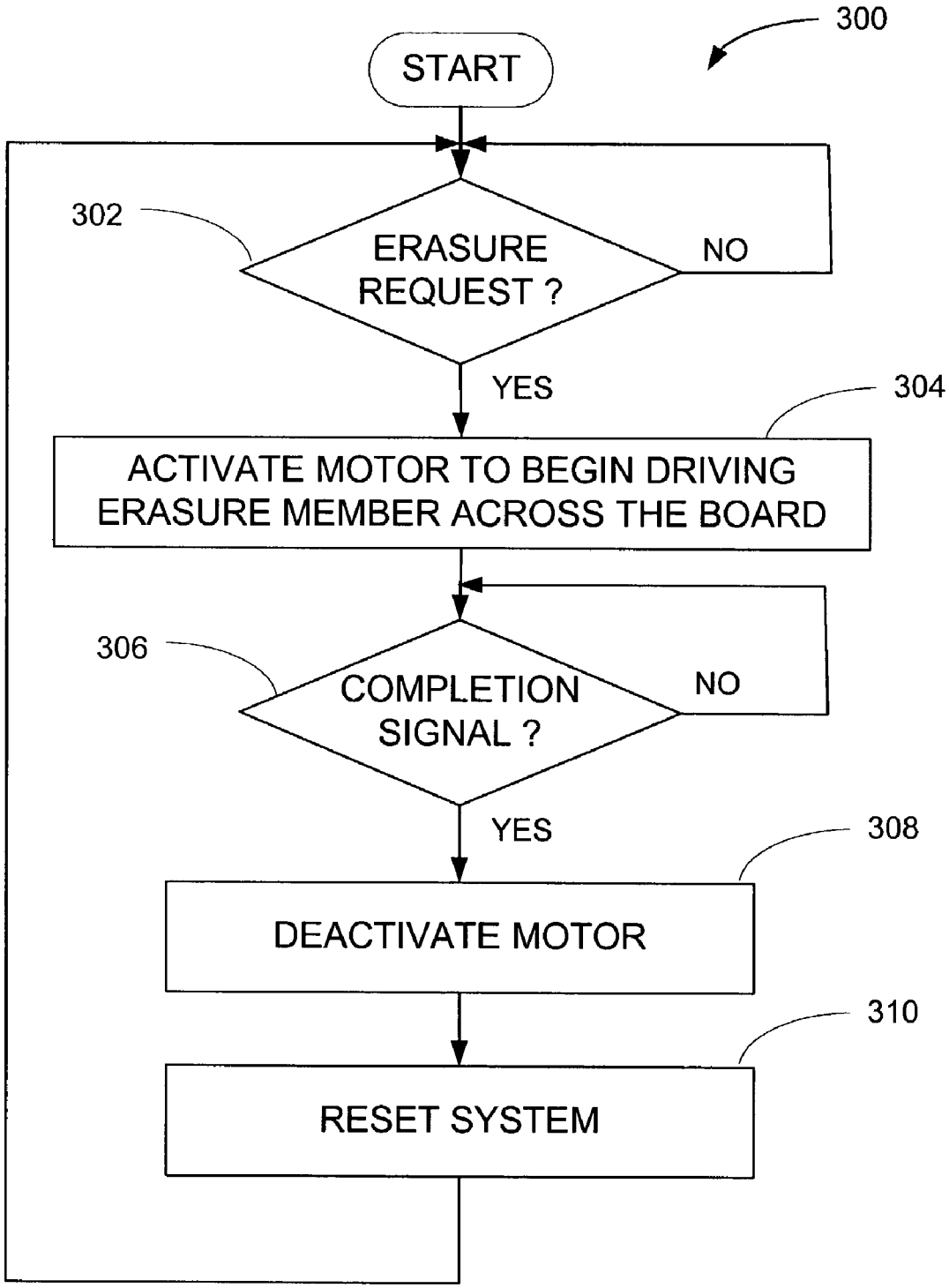
FIG. 3 is a flow diagram of automatic erasure processing according to one embodiment of the invention.

FIG. 3 is a flow diagram of automatic erasure processing 300 according to one embodiment of the invention. The automatic erasure processing 300 begins with a decision 302 that determines whether an erasure request has been received. As an example, an erasure request can correspond to a user activating an erasure switch (e.g., push button switch) to signal the automatic board erasure system to begin erasure processing. In any case, when the decision 302 determines that an erasure request has not been received, the automatic erasure processing 300 awaits such a request. In other words, the automatic erasure processing 300 is activated once an erasure request has been received.

Accordingly, once the decision 302 determines that an erasure request has been received, the motor is activated 304 to begin driving an eraser member (e.g., erasure strip) across a board. After the motor has been activated 304, the automatic erasure processing 300 awaits a completion signal. In particular, a decision 306 determines whether a completion signal has been received. When the decision 306 determines that a completion signal has not yet been received, the automatic erasure processing 300 continues to await a completion signal while the motor continues to drive the eraser member across the board. The completion signal serves to inform the automatic erasure processing 300 that the erasure of the board has completed. Hence, once the decision 306 determines that a completion signal has been received, the motor is deactivated 308. Thereafter, the system is reset 310. In one embodiment, the system is reset 310 such that the driving direction for the eraser member is reversed. For example, if the eraser member was previously driven left to right across the surface of the board, then after being reset, the motor will drive the eraser member in a right to left direction the next time the motor is activated to drive the eraser strip across the surface of the board. Alternatively, the automatic erasure processing 300 can be reset 310 by immediately driving the eraser member back to its original position. Such an embodiment takes more time to complete the erasure processing but may be advantageous in that two swipes (i.e., two passes) across the surface of the board are provided which may help improve the quality of the erasure being performed. Following the operation 310, the automatic erasure processing 300 returns to repeat the decision 302 and subsequent operations so that the automatic erasure processing 300 is available to again be invoked upon receiving a subsequent erasure request.

Figure 4:
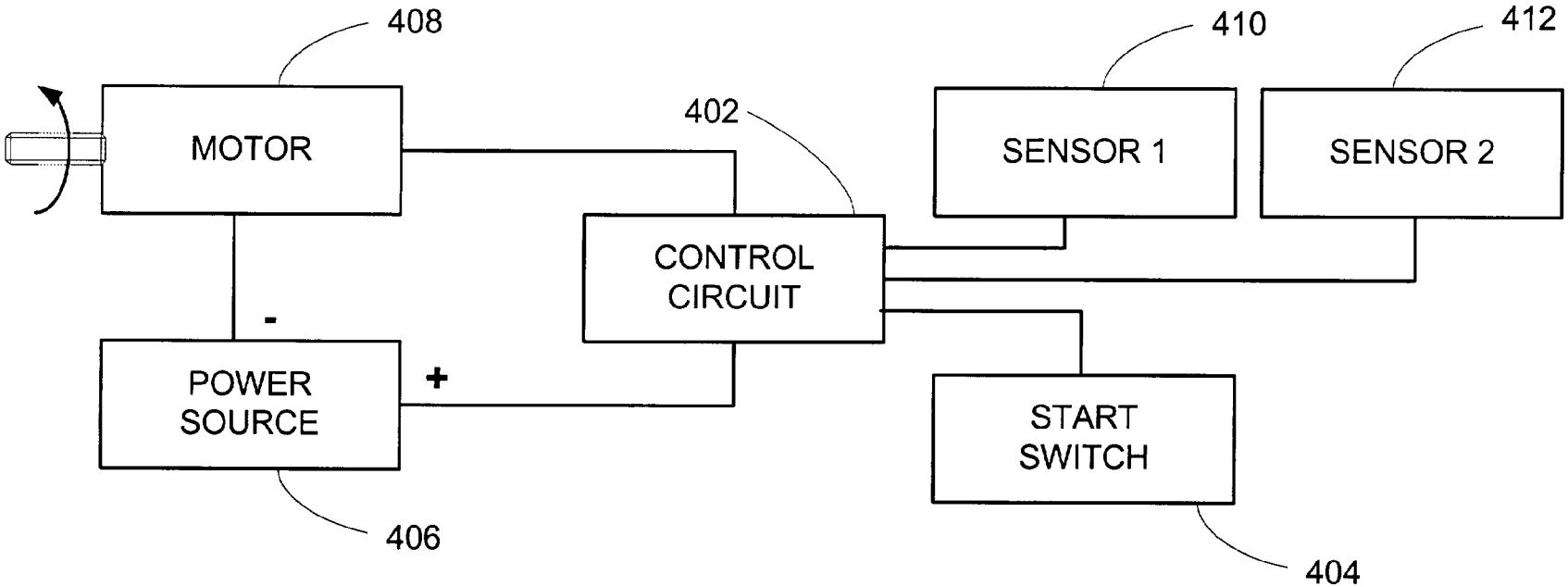
FIG. 4 is a block diagram of an erasure control system according to one embodiment of the invention.

FIG. 4 is a block diagram of an erasure control system 400 according to one embodiment of the invention. The erasure control system 400 can be used with any of the above-noted embodiments for automatic board erasure systems. The erasure control system 400 can also perform the automatic erasure processing 300 illustrated in FIG. 3.

The erasure control system 400 includes a control circuit 402 that controls erasure processing. The erasure control system 400 also includes a start switch 404 that provides a start signal to the control circuit 402. Typically, a user would cause the start switch 404 to produce the start signal when a board is to be erased. When the control circuit 402 detects the start signal, the control circuit 402 can couple power provided by a power source 406 to a motor 408, thereby permitting the motor 408 to be activated. The power source 406 can be a battery or a power outlet. For example, the power source 406 can be provided by a regulated AC current provided by a power outlet. In addition, the erasure control system 400 includes sensors 410 and 412 that couple to the control circuit 402. The sensors 410 and 412 are typically optical or electromechanical elements. The sensors 410 and 412 are placed with respect to the board to be erased. For example, the sensor 410 can be provided at a left edge of the board being erased, and the sensor 412 can be provided at a right edge of the board to be erased. Hence, when the control circuit 402 activates the motor 408, the eraser member is being driven left to right. Later, when the sensor 412 detects that the eraser member has arrived at the right edge of the board, the sensor 412 provides a signal to the control circuit 402. Upon receiving the signal from the sensor 412, the control circuit 402 decouples the power source 406 from the motor 408, thereby deactivating the motor 408. Alternatively, if the eraser member was being driven right to left, the sensor 410 would provide a signal to the control circuit 402 when the eraser member arrives at the left edge of the board. The control circuit 402 would likewise deactivate the motor 408 by decoupling the power source 406 from the motor 408. In one embodiment, the control circuit 402 includes a relay that isolates the control signals from the power loop provided between the power source 406 and the motor 408. Here, the signals from the start switch 404 and the sensors 410 and 412 are control signals.

The advantages of the invention are numerous. Different embodiments or implementations may yield one or more of the following advantages. One advantage of the invention is that board erasure is able to be performed in an automated manner. Another advantage of the invention is that the erasure can be achieved in a uniform manner. Still another advantage of the invention is that it is very easy to use. Yet another advantage of the invention is that an automated erasure system can be provided as an add-on to a previously acquired board.

The many features and advantages of the present invention are apparent from the written description, and thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A system for automatic erasure of a board, said system comprising:

a motor;

a rod having at least one gear, said rod being positioned proximate to one side of the board, and said rod capable of being rotatably driven by said motor;

at least one threaded rod extending at least substantially over the length of the board, said at least one threaded rod having at least one counterpart gear that is coupled against the at least one gear of said rod;

an eraser member having at least one threaded opening to receive said at least one threaded rod;

at least one non-threaded rod that extends across the board to guide said eraser member as said eraser member is being moved across the board;

at least one sensor operatively connected to said motor, said sensor operating to deactivate said motor and reset said system such that the driving direction for said eraser member is reversed after said eraser member has completed a pass across the board; and a user switch to activate said motor, wherein upon activation of said motor, said rod is rotatably driven to rotate the at least one gear as well as the at least one counterpart gear coupled thereto, thereby causing said at least one threaded rod to rotate and thereby move said eraser member across the board to erase non-permanent markings from the board.

2. A system as recited in claim 1, wherein the board has a two-dimensional surface, and wherein said eraser member extends in a first direction across the two-dimensional surface, and wherein said motor operates to drive said eraser member across the board in a second direction while said eraser member is biased against the board.

3. A system as recited in claim 2, wherein said system provides uniform erasure of the non-permanent markings from the board.

4. A system as recited in claim 1, wherein said motor is reversible in its driving direction.

5. A system as recited in claim 1, wherein the board is a whiteboard.

6. A system as recited in claim 1, wherein said system further comprises:

a force adjustment mechanism that adjustably controls the amount of force said at least one threaded rod exerts on said eraser member to force said eraser member against the board.

7. A system for automatic erasure of a board, said system comprising:

a motor;

a rod having at least one gear, said rod being positioned proximate to one side of the board, the board having a two-dimensional surface, and said rod capable of being rotatably driven by said motor;

at least one threaded rod extending at least substantially over the length of the board, said at least one threaded rod having at least one counterpart gear that is coupled against the at least one gear of said rod;

at least one non-threaded rod that extends across the board to guide said eraser member as said eraser member is being moved across the board;

an eraser member which extends in a first direction across the two-dimensional surface and which has at least one threaded opening to receive said at least one threaded rod and said motor operates to drive said eraser member across the board in a second direction while said eraser member is biased against the board; and a user switch to activate said motor, wherein upon activation of said motor, said rod is rotatably driven to rotate the at least one gear as well as the at least one counterpart gear coupled thereto, thereby causing said at least one threaded rod to rotate and thereby move said eraser member across the board in a second direction while said eraser is biased against the board to erase non-permanent markings from the board, at least one sensor operatively connected to said motor, said sensor operating to deactivate said motor after said eraser member has completed a pass across the board, and wherein said system provides uniform erasure of the non-permanent markings from the board.

8. A system as recited in claim 7, wherein said motor is reversible in its driving direction.

9. A system as recited in claim 7, wherein the board is a whiteboard.

* * * * *